US008281865B2

(12) United States Patent
Joseph et al.

(10) Patent No.: US 8,281,865 B2
(45) Date of Patent: Oct. 9, 2012

(54) TUBULAR VALVE SYSTEM AND METHOD

(75) Inventors: Paul Joseph, Missouri City, TX (US); John R. Abarca, Houston, TX (US); Luis E. Mendez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 311 days.

(21) Appl. No.: 12/497,076

(22) Filed: Jul. 2, 2009

(65) Prior Publication Data

US 2011/0000679 A1 Jan. 6, 2011

(51) Int. Cl.
*E21B 34/06* (2006.01)

(52) U.S. Cl. ..... 166/373; 166/334.1; 166/319; 137/601.13

(58) Field of Classification Search ..... 166/373, 166/334.1, 332.1, 319, 66.6; 137/601.13, 137/601.14, 601.15
See application file for complete search history.

(56) References Cited

U.S. PATENT DOCUMENTS

| | | | | |
|---|---|---|---|---|
| 3,469,591 | A | 9/1969 | Odendahl | |
| 3,980,135 | A | 9/1976 | Garrett | |
| 4,026,363 | A * | 5/1977 | Yonker et al. | 166/381 |
| 4,066,128 | A * | 1/1978 | Davis et al. | 166/373 |
| 4,357,952 | A | 11/1982 | Knecht | |
| 4,360,064 | A | 11/1982 | O'Connor, III et al. | |
| 4,441,558 | A | 4/1984 | Welch et al. | |
| 4,629,002 | A | 12/1986 | Pringle | |
| 4,790,378 | A * | 12/1988 | Montgomery et al. | 166/66 |
| 4,951,752 | A | 8/1990 | Coleman | |
| 4,962,815 | A | 10/1990 | Schultz et al. | |
| 4,976,314 | A | 12/1990 | Crawford et al. | |
| 5,018,575 | A | 5/1991 | Parsons | |
| 5,291,947 | A | 3/1994 | Stracke | |
| 5,297,634 | A | 3/1994 | Loughlin | |
| 5,743,497 | A | 4/1998 | Michael | |
| 5,803,119 | A | 9/1998 | Steinke | |
| 5,803,179 | A | 9/1998 | Echols et al. | |
| 5,896,928 | A | 4/1999 | Coon | |
| 6,112,817 | A | 9/2000 | Voll et al. | |
| 6,334,486 | B1 | 1/2002 | Carmody et al. | |
| 6,382,569 | B1 | 5/2002 | Schattner et al. | |
| 6,619,392 | B2 | 9/2003 | Marangoni et al. | |
| 6,644,412 | B2 | 11/2003 | Bode et al. | |
| 6,810,955 | B2 | 11/2004 | Roth et al. | |

(Continued)

FOREIGN PATENT DOCUMENTS

WO WO99/05395 2/1999

OTHER PUBLICATIONS

International Search Report and Written Opinion; Date of Mailing Feb. 10, 2011; International Appln No. PCT/US2010/039952; International Search Report 5 pages; Written Opinion 3 pages.

(Continued)

*Primary Examiner* — Nicole Coy
(74) *Attorney, Agent, or Firm* — Cantor Colburn LLP

(57) ABSTRACT

A tubular valve system includes, a tubular, a primary valve actuatable to control occlusion of at least one port fluidically connecting an inner bore of the tubular with an outside of the tubular, and a contingency valve actuatable to control occlusion of at least one port fluidically connecting the inner bore with the outside of the tubular.

24 Claims, 5 Drawing Sheets

U.S. PATENT DOCUMENTS

| | | | | |
|---|---|---|---|---|
| 6,883,610 | B2 | 4/2005 | Depiak | |
| 6,883,613 | B2 | 4/2005 | Bode et al. | |
| 7,222,676 | B2 | 5/2007 | Patel et al. | |
| 7,255,178 | B2 | 8/2007 | Slup et al. | |
| 7,261,155 | B1 | 8/2007 | Ward et al. | |
| 7,273,106 | B2 | 9/2007 | Huckabee et al. | |
| 7,387,165 | B2 * | 6/2008 | Lopez de Cardenas et al. | 166/313 |
| 2001/0040033 | A1 | 11/2001 | Schnatzmeyer et al. | |
| 2002/0020534 | A1 | 2/2002 | Wilson et al. | |
| 2007/0163774 | A1 | 7/2007 | Hosatte et al. | |
| 2007/0181312 | A1 | 8/2007 | Kritzler et al. | |
| 2008/0035350 | A1 | 2/2008 | Henriksen et al. | |
| 2008/0041581 | A1 | 2/2008 | Richards | |
| 2008/0047703 | A1 | 2/2008 | Stoesz et al. | |
| 2008/0190608 | A1 | 8/2008 | Coronado et al. | |
| 2008/0283238 | A1 | 11/2008 | Richards et al. | |
| 2009/0008078 | A1 | 1/2009 | Patel | |
| 2009/0095468 | A1 | 4/2009 | Augustine et al. | |
| 2009/0120647 | A1 | 5/2009 | Turick et al. | |
| 2011/0000660 | A1 | 1/2011 | Joseph et al. | |
| 2011/0000679 | A1 | 1/2011 | Joseph et al. | |

OTHER PUBLICATIONS

International Search Report and Written Opinion; Date of Mailing Feb. 10, 2011; International Apln No. PCT/US2010/039957; International Search Report 5 pages; Written Opinion 4 pages.

International Search Report; PCT/US2010/039611; Korean Intellectual Property Office; Mailed Feb. 8, 2011.

International Search Report; PCT/US2010/039946; Korean Intellectual Property Office; Mailed Feb. 8, 2011.

International Search Report and Written Opinion, Mailed Feb. 10, 2011; International Appln No. PCT/US2010/039968; International Search Report 5 pages; Written Opinion 3 pages.

International Search Reportand Written Opinion; Date of Mailing February 7, 2011; International Appln No. PCT/US2010/039479, International Search Report 5 pages; Written Opinion 4 pages.

Baker Oil Tools "Waterflood Regulators" Flow Control Catalog, Waterflood Regulators/Accessories, p. 78, Baker Oil Tools, Jul. 2004.

Brian Champion "A New Wireless Solution to Real Time Reservoir Surveillance and In-flow Control-Applications of Interest for Underground Gas Storage" For presentation at the 9th Annual Global Gas Village Summit (Europe), Milan, Italy Apr. 14-16, 2009, Expro 2009, pp. 1-24.

Gai, H., "Requirements of Downhole Flow Control Valve," SPE Annual Technical Conference and Exhibition, Denver, Colorado, Oct. 5-8, 2003. SPE Paper No. 84323-MS.

Cyvas, M.K., et al. "Subsea Adjustable Choke Valves: A Focus on a Critical Component," SPE Production Engineering, vol. 4, No. 3, Aug. 1989, pp. 301-208. SPE Paper No. 16609-PA.

Winkler, H.W., et al., "Dynamic Performance Testing of Single-Element Unbalances Gas-Life Valves," SPE Production Engineering, vol. 2, No. 3, Aug. 1987, pp. 183-190. SPE Paper No. 14348-PA.

Kelkouli, Redha, et al., "Case Study in Water Shutoff Fluid Placement Using Straddled Through-Tubing Inflatable-Packers Technique," SPE Middle East Oil and Gas Show and Conference, Kingdom of Bahrain, Mar. 11-14, 2008. SPE Paper No. 104755-MS.

Blount, C.G., et al., "Inflatable CT Conveyed Selective Well Testing System for Logging Openhole and Horizontal Wellbored: Development and Use," SPE/IcoTA Coiled Tubing Conference and Exhibition, Houston, Texas, Apr. 8-9, 2003. SPE No. 81718-MS.

International Search Report and Written Opinion, Mailed May 9, 2011, International Appln. No. PCT/US2010/050533, Written Opinion 4 pages, International Search Report 5 pages.

* cited by examiner

TUBULAR VALVE SYSTEM AND METHOD

CROSS REFERENCE TO RELATED APPLICATIONS

This application contains subject matter related to the subject matter of co-pending applications, which are assigned to the same assignee as this application, Baker Hughes Incorporated of Houston, Tex. The below listed applications are hereby incorporated by reference in their entirety:

U.S. patent application Ser. No. 12/497,070 (filed Jul. 2, 2009), entitled MODULAR VALVE BODY AND METHOD OF MAKING; and U.S. patent application Ser. No. 12/497,083 (filed Jul. 2, 2009), entitled TUBULAR VALVING SYSTEM AND METHOD.

BACKGROUND

Tubular valves that control occlusion of ports that fluidically connect an inner bore of a tubular with an outside of the tubular are commonly used in several industries including the downhole completion industry. Such valves are deployed in boreholes to control fluid flow in both directions, inside to outside of the tubular as well as outside to inside of the tubular, through the ports. Remote control of these valves provides advantages in operational efficiencies, in comparison to valves that require active interventive actuation, and have thus become quite popular. Remotely controlled valves, however, can malfunction. Costs associated with removal of the valves from the borehole to repair or replace the valve, in addition to the cost of lost production while the well is not producing, are a few of the concerns associated with use of these valves. Systems and methods that overcome the foregoing concerns would be well received in the art.

BRIEF DESCRIPTION

Disclosed herein is a tubular valve system. The system includes, a tubular, a primary valve actuatable to control occlusion of at least one port fluidically connecting an inner bore of the tubular with an outside of the tubular, and a contingency valve actuatable to control occlusion of at least one port fluidically connecting the inner bore with the outside of the tubular.

Further disclosed herein is a method of valving a tubular. The method includes, actively actuating a primary valve disposed at the tubular, and maintaining a contingency valve disposed at the tubular in reserve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
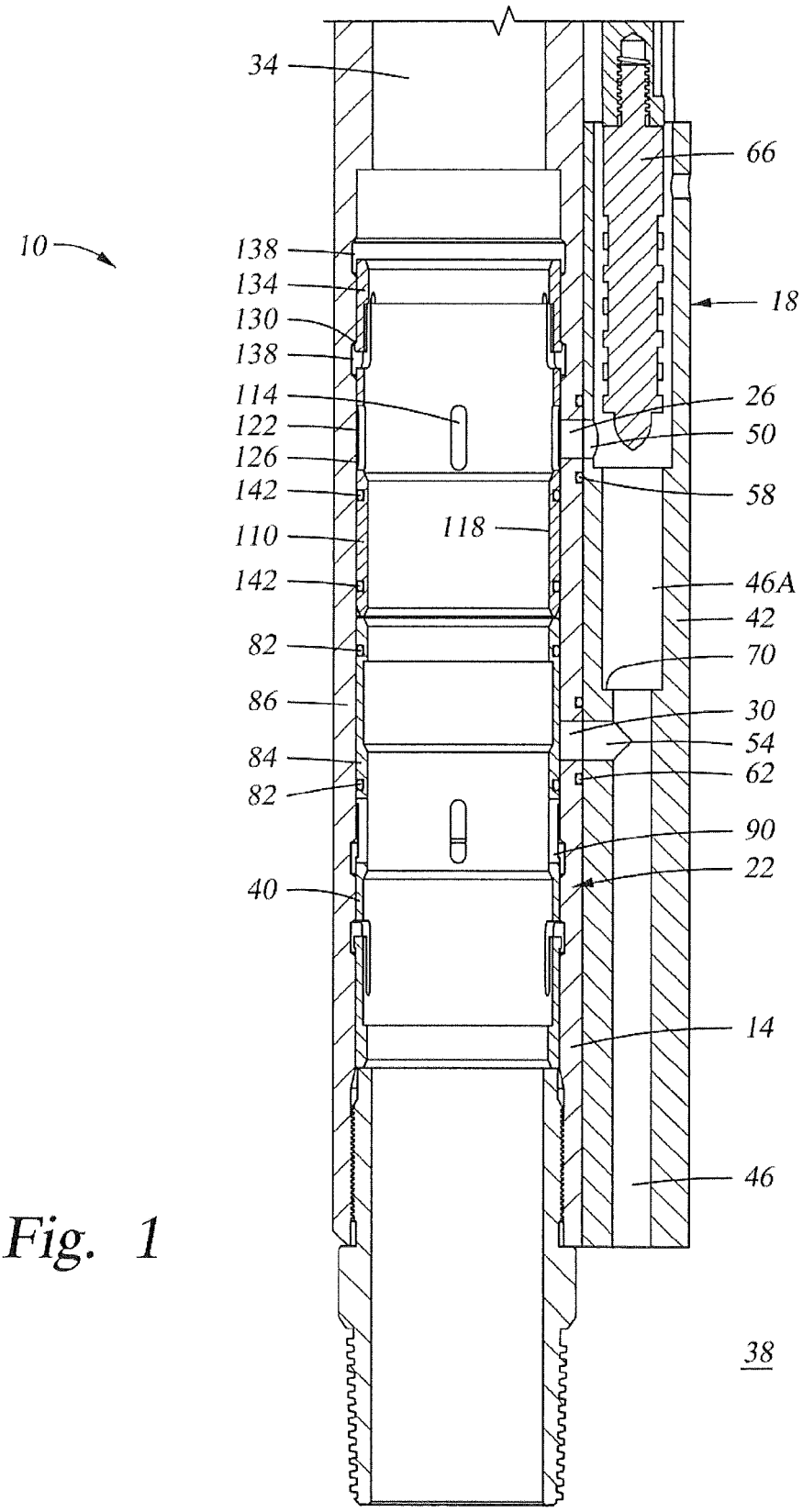
FIG. 1 depicts a partial cross sectional view of a tubular valve system disclosed herein with the primary valve open and the contingency valve closed.

Referring to FIG. 1, an embodiment of a tubular valve system disclosed herein is illustrated generally at 10. The valve system 10 includes, a tubular 14 with a primary valve 18 and a contingency valve 22 disposed thereat. The tubular 14 includes at least one first port 26 and at least one second port 30 that both fluidically connect an inner bore 34 of the tubular 14 with an outside 38 of the tubular 14. The primary valve 18 is configured to control occlusion of the first port 26 while the contingency valve 22 is configured to control occlusion of at least the second port 30, with additional control of occlusion of the first port 26 by the contingency valve 22 being optional. The contingency valve 22 has a sleeve 40 that is slidably engaged with the tubular 14. In this embodiment, the sleeve 40 is positioned within the inner bore 34 of the tubular 14. The sleeve 40 is movable relative to the tubular 14 such that movement of the sleeve 40 can fully occlude the second port 30. The sleeve 40 can be passive so that it is moved by mechanical engagement therewith by a shifting tool (not shown), for example. Additionally, an alternate actuator such as an actuator that uses an atmospheric chamber that is collapsed during actuation could shift the sleeve 40.

In this embodiment, the primary valve 18 is an actively controlled valve and as such is configured to be controlled remotely as will be described in detail below. The foregoing construction allows an operator to control the primary valve 18 and directly control the contingency valve 22. As such, the primary valve 18 can be used by an operator to control flow between the inner bore 34 and the outside 38 indefinitely, while maintaining the contingency valve 22 in reserve. The contingency valve 22 can be employed to control flow between the inner bore 34 and the outside 38 at any time, including when the primary valve 18 fails to operate properly, due to jamming by contamination, for example.

The primary valve 18, in this embodiment, includes an elongated member 42 with a bore 46 that extends longitudinally therethrough. A first port 50 and a second port 54 in the elongated member 42 align with the first port 26 and the second port 30 in the tubular 14 and fluidically connect with the bore 46. As such, both ports 26 and 30 are in fluidic communication with the outside 38 through the ports 50 and 54 and the bore 46. Seals 58 and 62, illustrated herein as o-rings, seal the elongated member 42 to the tubular 14 to prevent leakage of fluid from the ports 50 and 54 to the outside 38 from between the elongated member 42 and the tubular 14. A valve stem 66 is movable within a portion 46A of the bore 46 into sealable engagement with a shoulder 70 of the bore 46, thereby occluding fluidic communication between the inner bore 34 and the outside 38 through the first ports 26 and 50. The valve stem 66 in this view is shown in a position that is not sealed to the shoulder 70 and thus the inner bore 34 is in fluidic communication with the outside 38 through the first ports 26 and 50.

Figure 2:
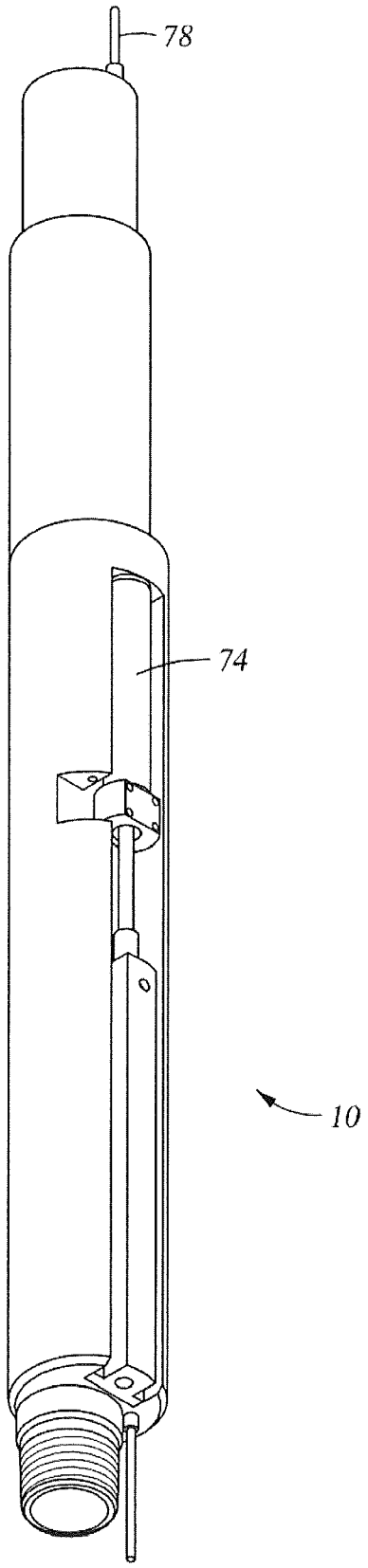
FIG. 2 depicts a perspective view of the tubular valve system of FIG. 1.

Referring to FIG. 2, the valve stem 66, in this embodiment, is driven by an actuator 74, depicted herein as an electric actuator, that is controlled by electrical power supplied via a signal carrier 78, depicted herein as an electric supply line or control line. The signal carrier 78 can extend indefinitely in either or both directions along the tubular 14 from the valve system 10. For example, the signal carrier 78 may extend to a surface in applications wherein the valve system 10 is deployed within a wellbore (not shown) in an earth formation to allow remote control operation of the valve system 10 from the surface. Other embodiments can use alternate actuators 74 to actuate the primary valve 18, such as, a hydraulic actuator (not shown) that can be supplied hydraulic power through a signal carrier 78 that includes fluidic supply lines.

Referring again to FIG. 1, the sleeve 40 of the contingency valve 22 is illustrated in this view in a position that fully occludes the second ports 30 and 54. A pair of seals 82, shown herein as o-rings, slidably seal walls 84 of the sleeve 40 to walls 86 of the tubular 14 on either longitudinal side of the second port 30. At least one second port 90 through the walls 84 of the sleeve 40, in this view, is shown located longitudinally outboard of both seals 82 and is therefore fluidically isolated from the second ports 30 and 54, and therefore maintains the contingency valve 22 in a closed position.

Figure 3:
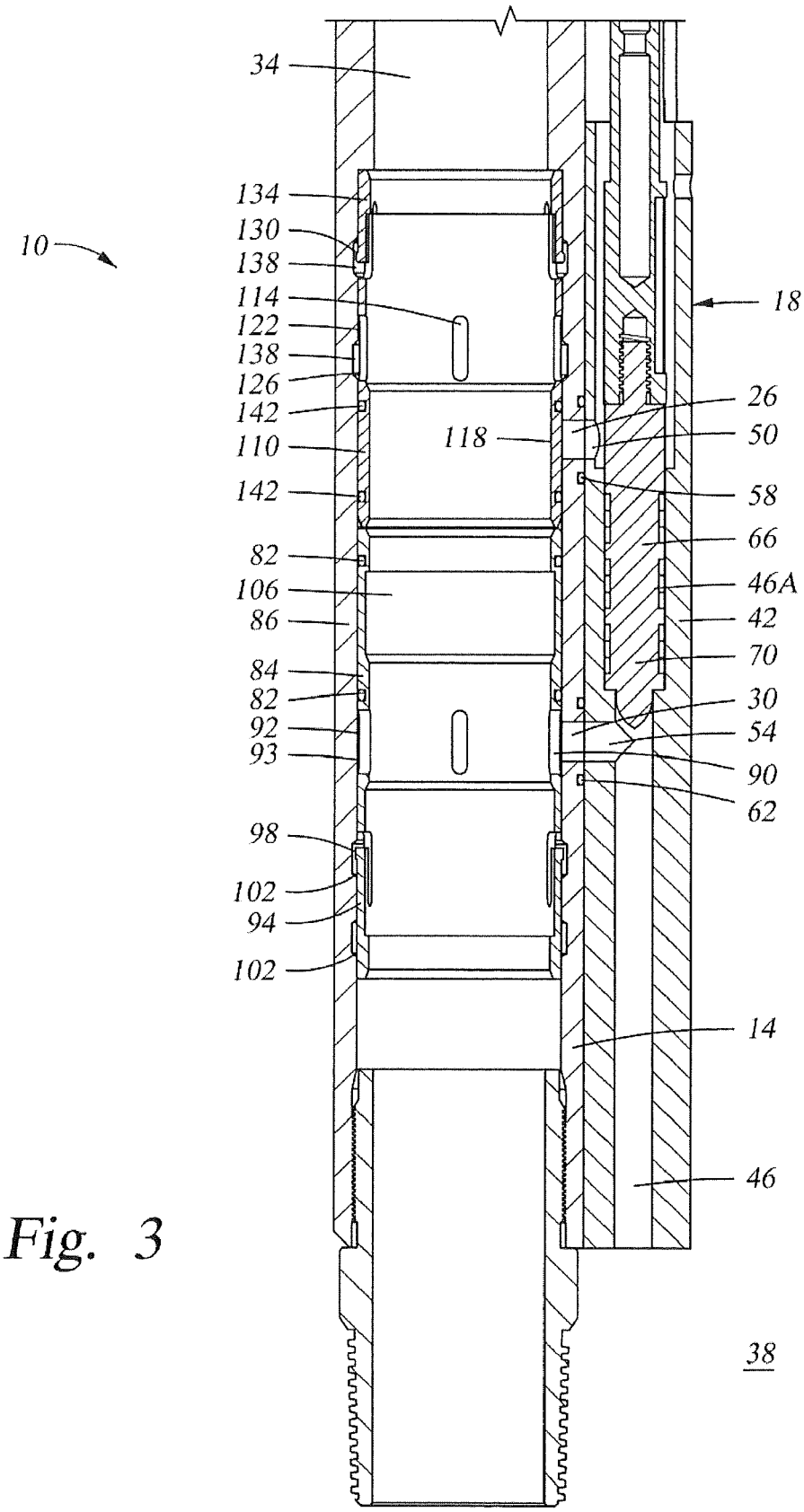
FIG. 3 depicts a partial cross sectional view of the tubular valve system of FIG. 1 with the primary valve closed and the contingency valve open.

Referring to FIG. 3, the sleeve 40, in this view, is illustrated in a position such that the second port 90 is longitudinally aligned with the second ports 30 and 54 thereby fluidically connects the inner bore 34 with the outside 38 maintaining the contingency valve 22 in an open position. A recess 92 defined by a portion of the sleeve 40 having a reduced radial dimension, is longitudinally aligned with the second port 90 to create an annular space 93 between the sleeve 40 and the tubular 14 to allow fluid to flow in the annular space 93 from between the at least one second port 90 and the second port 30 when the second port 90 is longitudinally aligned with the second port 30.

The sleeve 40, in this embodiment, also includes an optional collet 94 with collet fingers 98 that are biasingly engagable with a pair of recesses 102 formed in the walls 86 of the tubular 14. This engagement discourages unintentional movement of the sleeve 40 by positively maintaining the sleeve in one of the positions defined by the engagement of the collet fingers 98 within the recesses 102. Although the recesses 102 in this embodiment are located to maintain the sleeve 40 to either fully occlude the second port 30 with the sleeve 40 or to leave the second port 30 fully open to the second port 90. A profile 106 also formed in the walls 84 of the sleeve 40 provide a detail that is engagable with a shifting tool (not shown) to facilitated positive latching between the shifting tool and the sleeve 40 to facilitate movement of the sleeve 40.

An optional collar 110 with similar features to those of the sleeve 40 can be employed to be mechanically shifted to occlude the first port 26. Shifting the collar 110 may be desirable in the event that the valve stem 66 of the primary valve 18 ceases in an open position. Such a malfunction would present a permanent fluidic connection between the inner bore 34 and the outside 38. The collar 110 could then be used to permanently occlude the first port 26 to thereby allow control of fluid communication between the inner bore 34 and the outside 38 via mechanical shifting of the contingency valve 22 thereafter. The collar 110 is illustrated in FIG. 1 with a first port 114 through walls 118 thereof being longitudinally aligned with the first port 26, thereby providing fluid communication between the inner bore 34 and the outside 38 therethrough. A recess 122 defined by a reduced radial dimension of the walls 118 in longitudinal alignment with the first port 114 creates an annular space 126 between the collar 110 and the tubular 14 to permit fluid flow to flow therethrough between any of the first ports 114 and the first port 26.

The collar 110 is movable through contact with the sleeve 40 during movement of the sleeve 40 in a direction toward the collar 110. In alternate embodiments not illustrated herein the collar 110 could be moved by direct mechanical engagement with a shifting tool. Collet fingers 130 on a collet 134 of the collar 110 are biasingly engagable with recesses 138 in the walls 86 to discourage unintended movement of the collar 110 with respect to the tubular 14. Seals 142 slidably sealingly engage the walls 86 to the walls 118 a longitudinal dimension apart that spans at least the longitudinal dimension of the first port 26. As such, when the collar 110 is shifted to the position illustrated in FIG. 3, the seals 142 effectively fluidically deadhead the first port 26 to the walls 118 between the seals 142 thereby occluding fluid communication between the inner bore 34 and the outside 38.

Figure 4:
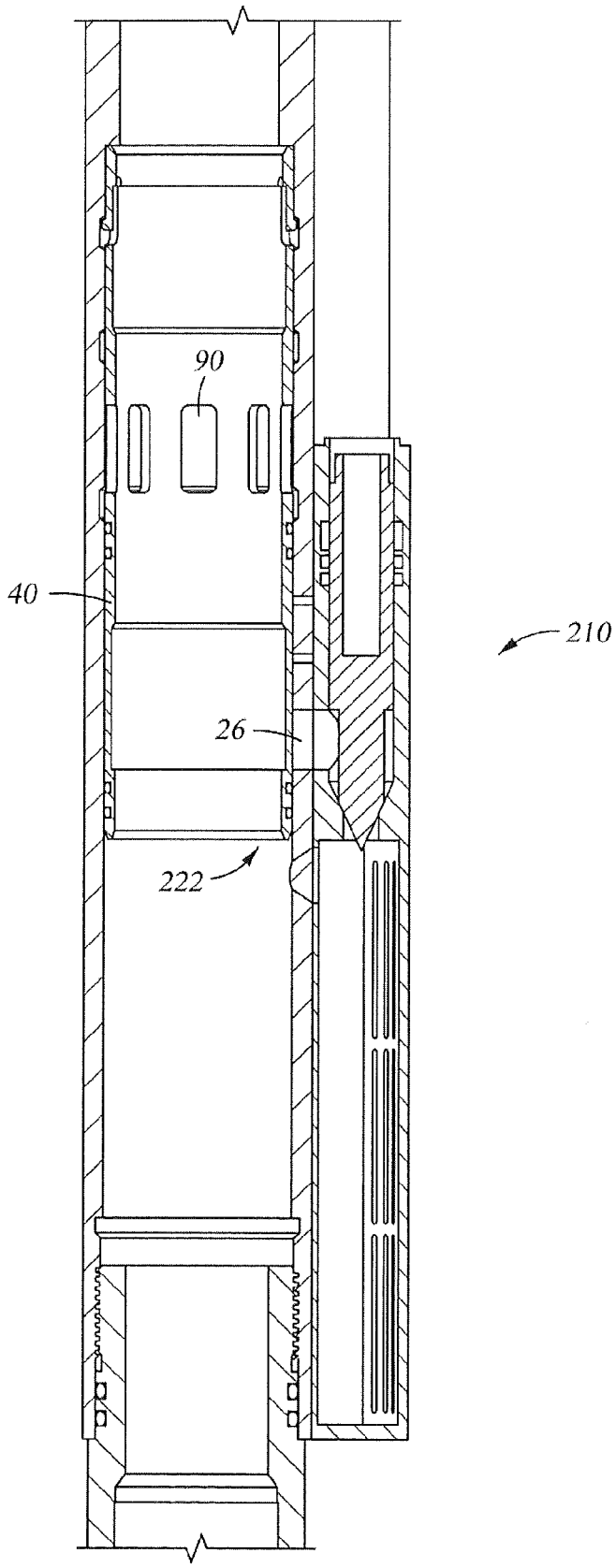
FIG. 4 depicts a partial cross sectional view of an alternate tubular valve system disclosed herein with the primary valve closed and the contingency valve closed.
Figure 5:
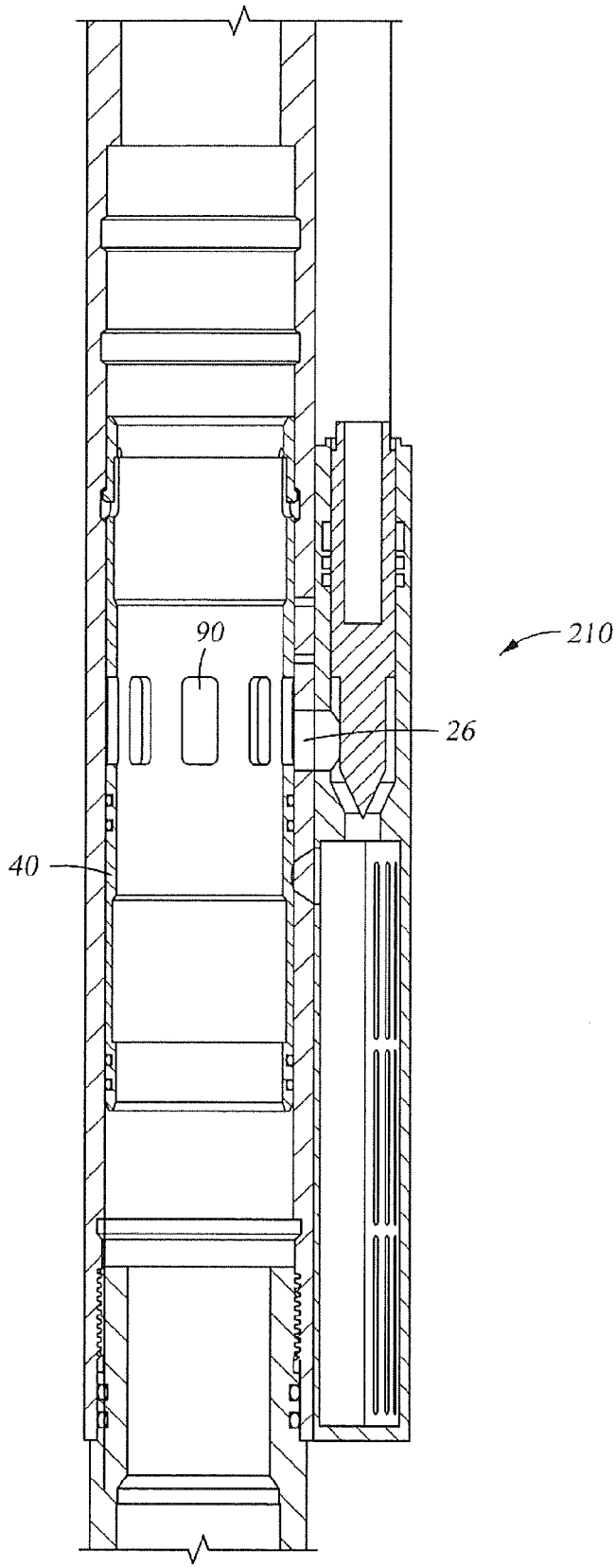
FIG. 5 depicts a partial cross sectional view of the tubular valve system of FIG. 4 with the primary valve open and the contingency valve open.

Referring to FIGS. 4 and 5, an alternate embodiment of a tubular valve system disclosed herein is illustrated generally at 210. Due to the similarities between the valve system 210 and the valve system 10, many items are identical and, as such, are numbered alike and are not described again in detail hereunder. A primary difference between the two valve systems 210 and 10 is that the valve system 210 has only the single first port 26 and not the second port 54, as are both included in the valve system 10. The valve system 210, having only the first port 26 negates the need for both the sleeve 40 and the collar 110, as are incorporated in the valve system 10 to selectively close the second port 54 and the first port 26, respectively. The sleeve 40 in the valve system 210, therefore, is used to selectively close the first port 26 and, as such, the valve system 210 does not include the collar 54.

In FIG. 4 the first port 26, as illustrated, is fully occluded by the contingency valve 222. In contrast, as illustrated in FIG. 5, the second ports 90 of the sleeve 40 are aligned with the first port 26, and the contingency valve 222 provides not blockage of the first port 26.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A tubular valve system, comprising:

a tubular;

a primary valve actuatable to control occlusion of at least one first port fluidically connecting a first volume at an inner bore of the tubular with a second volume at an outside of the tubular;

a contingency valve actuatable to control occlusion of at least one second port fluidically connecting the first volume at the inner bore with the second volume at the outside of the tubular; and a member configured to allow or occlude fluidic communication between the first volume at the inner bore of the tubular and the second volume at the outside of the tubular independently of the primary valve.

2. The tubular valve system of claim 1, wherein the primary valve is actively controlled and the contingency valve is passively controlled.

3. The tubular valve system of claim 1, wherein the tubular valve system is deployable within a wellbore.

4. The tubular valve system of claim 1, wherein the primary valve is controlled by one of electrical power and hydraulic pressure.

5. The tubular valve system of claim 1, wherein the contingency valve is controlled by mechanical actuation.

6. The tubular valve system of claim 1, wherein the contingency valve includes a sleeve that is movable relative to the tubular.

7. The tubular valve system of claim 6, wherein the sleeve has at least one contingency opening that can be aligned with the at least one second port to open the at least one second port or misaligned with the at least one second port to occlude the at least one second port.

8. The tubular valve system of claim 6, wherein the sleeve is slidably sealingly engaged with the tubular.

9. The tubular valve system of claim 6, further comprising a collet in operable communication with the sleeve and the tubular to maintain the sleeve in a position relative to the tubular when the sleeve is not being moved.

10. The tubular valve system of claim 6, wherein the sleeve includes a profile engagable with a shifting tool.

11. The tubular valve system of claim 1, wherein the member is a collar.

12. The tubular valve system of claim 11, wherein the collar is movable from a position not occluding the at least one first port to a position occluding the at least one first port by actuation of the contingency valve.

13. The tubular valve system of claim 1, wherein the member is configured to defeat the primary valve upon actuation thereof.

14. The tubular valve system of claim 1, wherein the at least one first port is not the at least one second port.

15. The tubular valve system of claim 1, wherein the member is in operable communication with the contingency valve such that actuation of the contingency valve to uncover the second port also moves the member to occlude the first port.

16. A method of valving a tubular, comprising:

actively actuating a primary valve disposed at the tubular and configured to control fluidic communication between a first volume and a second volume through a first port;

maintaining a contingency valve configured to control fluidic communication between the first volume and the second volume through a second port disposed at the tubular in reserve; and maintaining a member at the tubular configured to allow or occlude fluidic communication between the first volume and the second volume independently of the primary valve through the first port upon movement relative to the tubular in reserve.

17. The method of valving a tubular of claim 16, further comprising actuating the contingency valve upon loss of performance of the primary valve.

18. The method of valving a tubular of claim 17, wherein the actuating the contingency valve is via mechanical actuation.

19. The method of valving a tubular of claim 16, further comprising engaging the contingency valve with a shifting tool.

20. The method of valving a tubular of claim 16, further comprising moving a sleeve relative to the tubular.

21. The method of valving a tubular of claim 20, further comprising moving the member relative to the tubular.

22. The method of valving a tubular of claim 16, further comprising actuating the contingency valve to open the contingency valve.

23. The method of valving a tubular of claim 22, wherein the actuating the contingency valve includes closing the primary valve.

24. The method of valving a tubular of claim 22, further comprising defeating the primary valve with the actuating of the contingency valve.

* * * * *